US008356651B2

(12) United States Patent
Faraj

(10) Patent No.: US 8,356,651 B2
(45) Date of Patent: Jan. 22, 2013

(54) DEVICE AND SYSTEM TO APPLY FACETED BEADS

(76) Inventor: Zaher Faraj, Ridgefield, NJ (US)

( * ) Notice: Subject to any disclaimer, the term of this patent is extended or adjusted under 35 U.S.C. 154(b) by 293 days.

(21) Appl. No.: 12/562,232

(22) Filed: Sep. 18, 2009

(65) Prior Publication Data

US 2010/0294414 A1 Nov. 25, 2010

Related U.S. Application Data

(60) Provisional application No. 61/180,484, filed on May 22, 2009.

(51) Int. Cl.
*B30B 1/04* (2006.01)
*B44C 1/18* (2006.01)

(52) U.S. Cl. ..... 156/583.1; 156/378; 156/63; 156/297; 156/308.2; 100/92

(58) Field of Classification Search ..... 156/583.1
See application file for complete search history.

(56) References Cited

U.S. PATENT DOCUMENTS

| | | | | |
|---|---|---|---|---|
| 2,764,663 | A * | 9/1956 | Molyneaux | 219/494 |
| 3,480,876 | A * | 11/1969 | Barbini | 372/38.06 |
| 3,635,780 | A * | 1/1972 | Griggs et al. | 156/583.1 |
| 4,107,539 | A * | 8/1978 | Kirsch | 250/559.13 |
| 4,192,990 | A * | 3/1980 | Ziaylek, Jr. | 219/243 |
| 7,185,584 | B1 * | 3/2007 | Woods et al. | 100/320 |
| 2005/0230058 | A1 * | 10/2005 | Stroup | 156/583.1 |

* cited by examiner

*Primary Examiner* — Justin Fischer
*Assistant Examiner* — Philip N Schwartz
(74) *Attorney, Agent, or Firm* — Jeffrey Furr, Esq.; Furr Law Firm

(57) ABSTRACT

This invention is a personal bead attachment device. It consists of a base with a hot plate, a piston arm, a piston holder, spring and piston forming a pressure handle. There is a power source and a laser light from the piston. The user of the bead attachment device will plug it in and turn machine and laser light on from the back of the machine, in about 30 second the plate should be hot and ready to use. The user will place the fabric on top of the hot plate and place a bead on the top of fabric, the laser dot will tell the user the exact position of where the bead will be adhered.

2 Claims, 12 Drawing Sheets

DEVICE AND SYSTEM TO APPLY FACETED BEADS

BACKGROUND OF INVENTION

This invention relates generally to the applying of beads to fabric and more particularly bead designs.

1. Background

Beads have been attached at garments for thousands of years by sewing the beads on fabric by hand. This has always been a time consuming process taking hours and days of manual labor to attach the beads in the simplest of designs. This is true no matter how big or small a project.

2. Description of Prior Art

Many individual and families like to create their own garment designs. Beads are a natural to do this with.

Garments designs with beads has been around for many, many years. The beads are used to form designs or to essentiate parts of the garments. The biggest use of beads is in that of making dresses and women's accessories.

Endless designs can be made with any color beads and all can be combined with other type of embellishments such as embroidery, screen printing and many more. With new beading technique any design is possible such as Floral, Geometric, Letters and much more. The plastic beads need to be applied to fabric in this manner where any shape or pattern can be made with precision and consistency. In the past, to get this look, there were only the imported glass and plastic beads that were sewn on by hand in India, China, Haiti, Philippine and other countries where labor is very cheap. It can be very difficult for an individual or family to do.

For the foregoing reasons, there is a need for a method for a person to attached beads to garments that is fast, easy, precise, consistent and economically feasible. There is still room for improvement in the art.

SUMMARY OF INVENTION

The present invention relates to a method to put plastic beads on a garment.

Accordingly, it is an object of the present invention to place plastic beads and other items on a garment or fabric in a fast, easy, precise, consistent and economically feasible method. A current invention is a personal bead attachment device. It consists of a base with a hot plate, a piston arm, a piston holder, spring and piston forming a pressure handle. There is a power source and a laser light from the laser light generator in the piston arm.

The user of the bead attachment device will plug it in and turn machine and laser light using switches on from the back of the machine, in about 30 second the plate should be hot and ready to use. The user will place the fabric on top of the hot plate and place a bead on the top of fabric, the laser dot will tell the user the center of the hot plate, the exact position of where the bead will be adhered. The user will press the spring-loaded pressure handle down on top of the bead, for most fabric, all that is needed is a medium, pressure for four seconds. This action causes the bead to be melted and adhered to the fabric.

Using this method, endless designs can be made this way with any color beads and all can be combined with other type of embellishments such as embroidery, screen printing and many more.

Any design is possible including Floral, Geometric, Letters and much more. The uniqueness of this technique is that this is the first time that plastic beads are applied to fabric in this manner where any shape or pattern can be made with precision and consistency

BRIEF DESCRIPTION OF DRAWINGS

Without restricting the full scope of this invention, the preferred form of this invention is illustrated in the following drawings.

DETAILED DESCRIPTION

The following description of a method to attached beads to garments is demonstrative in nature and is not intended to limit the scope of the invention or its application of uses.

Figure 1:
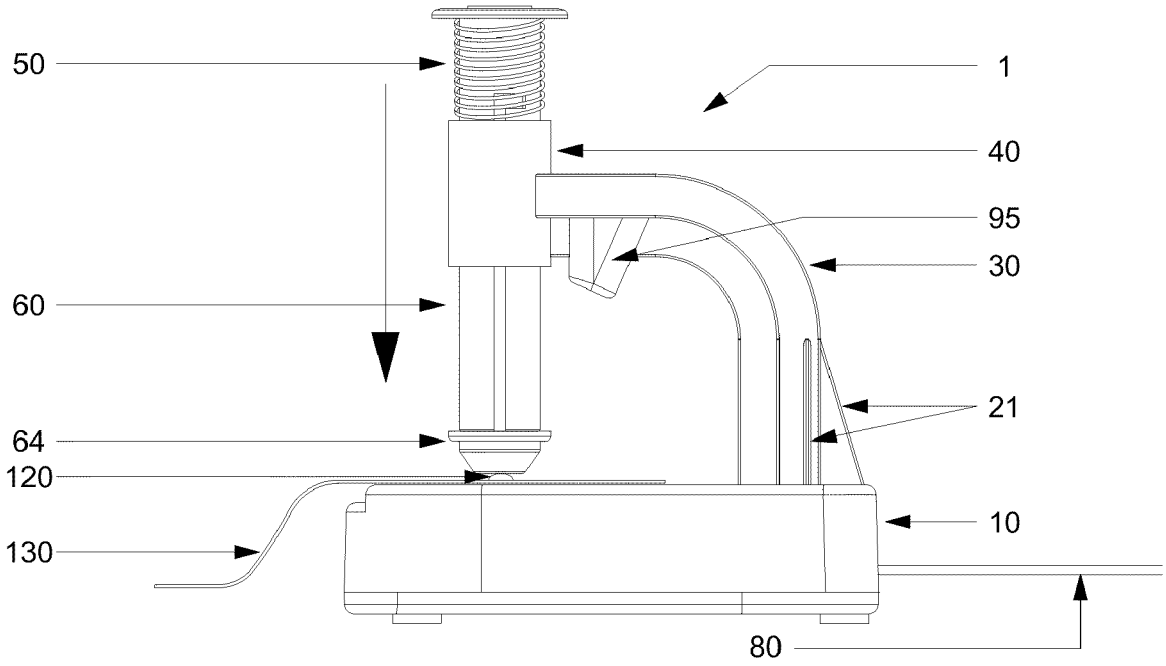
FIG. 1 displays the bead attachment device.

FIG. 1 displays the bead attachment device with the major components. It consists of a base 10 with a hot plate 20, a piston arm 30, a piston holder 40, spring 50 and piston 60. There is a power source 80 and a laser light 90 from the laser light generator 95 in the piston arm 30.

Figure 2:
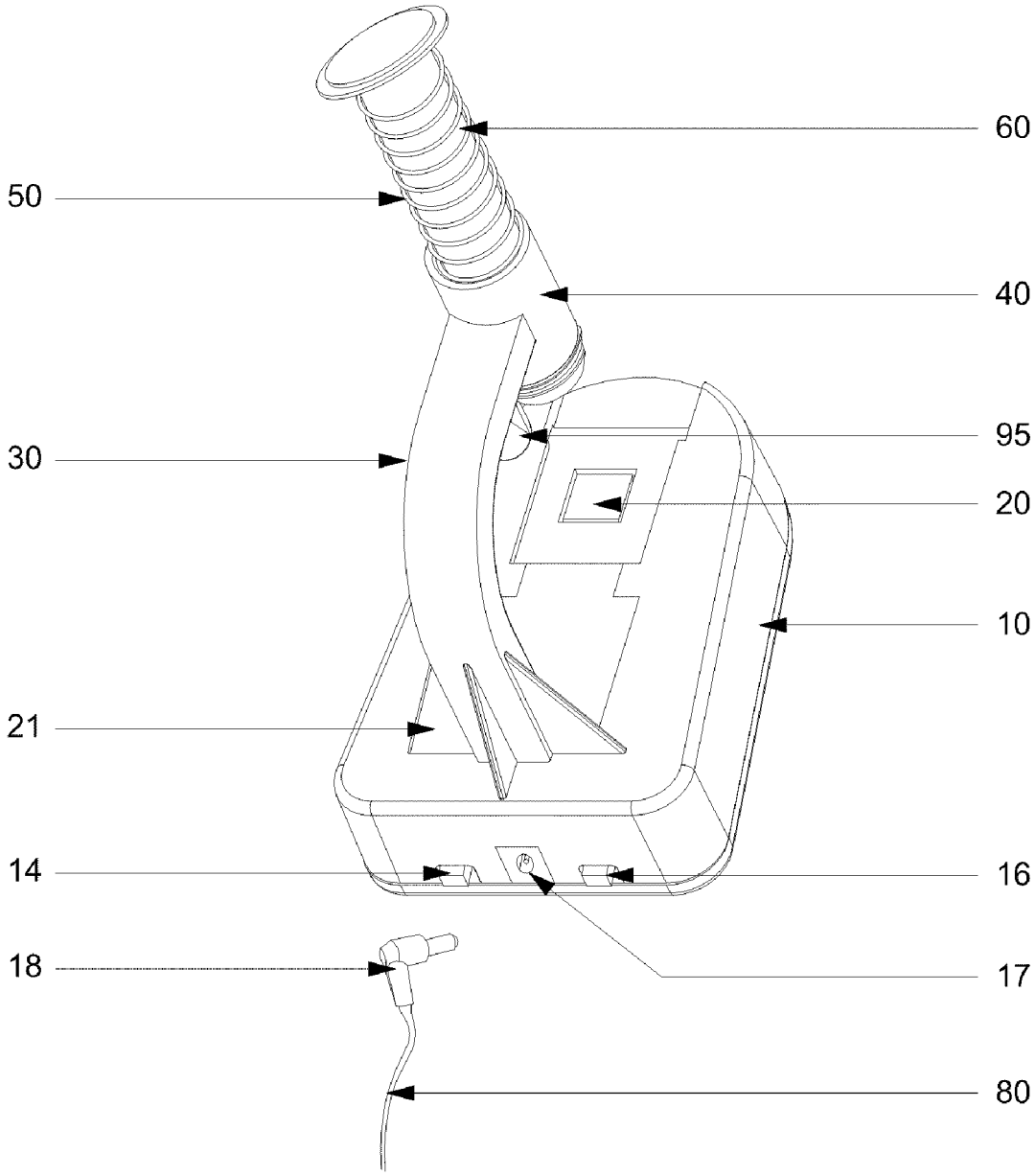
FIG. 2 shows the back of the device.
Figure 3:
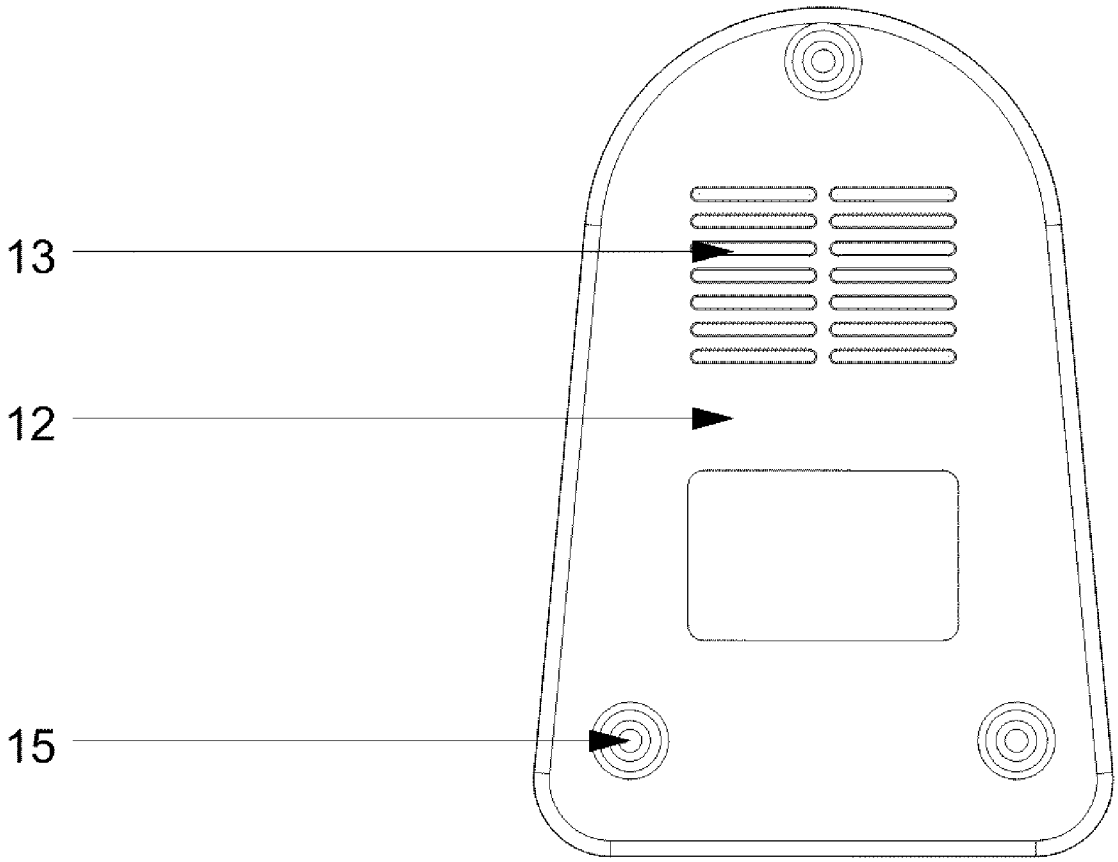
FIG. 3 shows the bottom of the base.

The base 10 has a hot plate 20 on the top of the base 10. The hot plate 20 is recessed from top surface of the base 10 as shown in FIG. 2. This recess allows the hot plate 20 to be used without danger of the user being burnt. The base 10 has sides with an on/off switch 14 for the hot plate 20 and an on/off switch 16 for the laser light Generator 95 on the back side of the base 10 as shown in FIG. 2. The bottom 12 of the base is shown in FIG. 3. In the preferred embodiment, the bottom 12 of the base has a plurality of legs 15 extending slightly from the bottom 12. The bottom 12 also has a vent 13 that allows heat from the hot plate 20 to escape from the base 10. The power source 80 in the preferred embodiment is a power cord 18 that connects to a power socket 17 in the back of the base 10.

The hot plate 20 is connected to the hot plate on/off switch 14 to the power source 80.

Extending perpendicular from the base 10 is the piston arm 30. The piston arm 30 curves up away from the base 10 and at the end of the piston arm 30 is the piston holder 40. The piston arm 30 has a plurality of fins 21 the extend perpendicular away for the piston arm 20 to provide stability to the piston arm 30.

Figure 4:
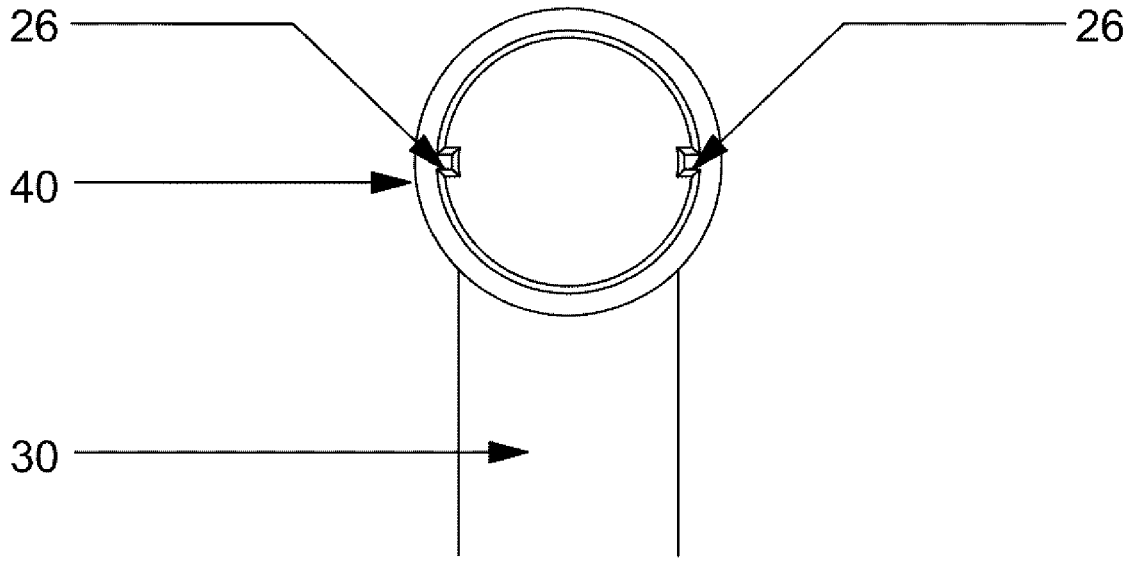
FIG. 4 shows the piston holder.

The piston holder 40, as shown in FIG. 4 is circular in shape and has a diameter that is slightly larger than the diameter of the piston 60. The piston holder 40 has a pair of locking ridges 26 which are across from each other.

Figure 5:
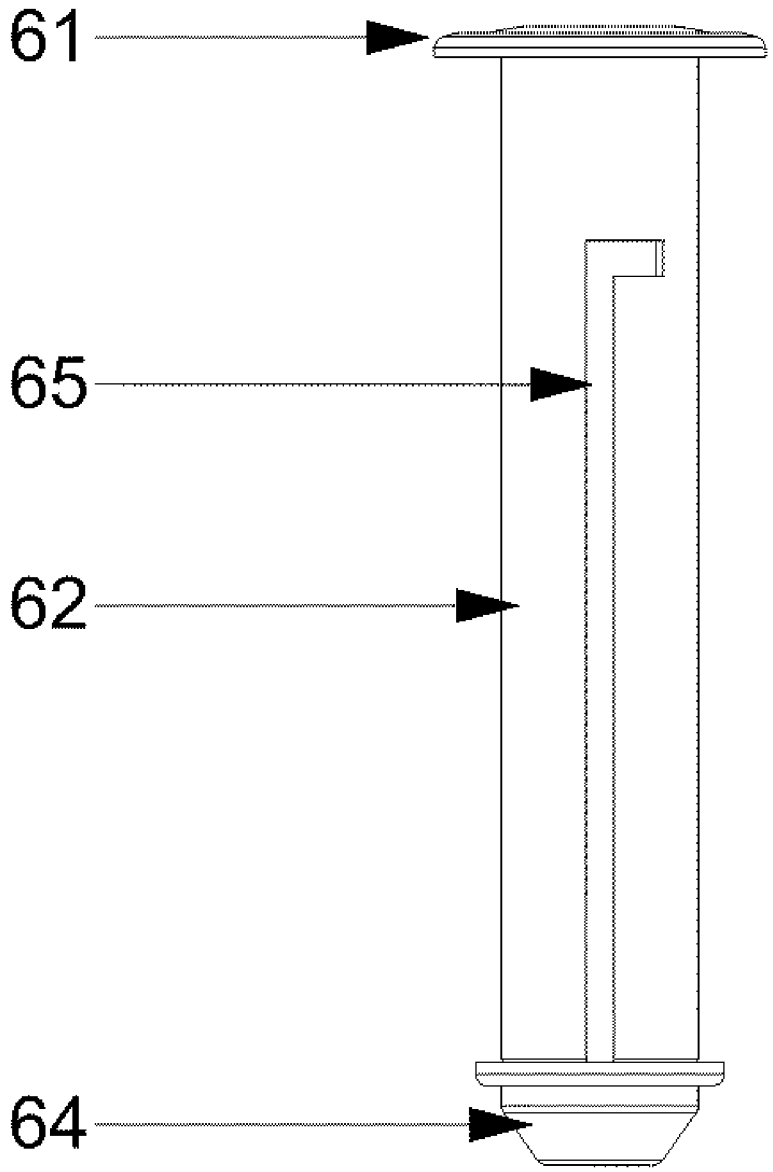
FIG. 5 displays the piston.
Figure 6:
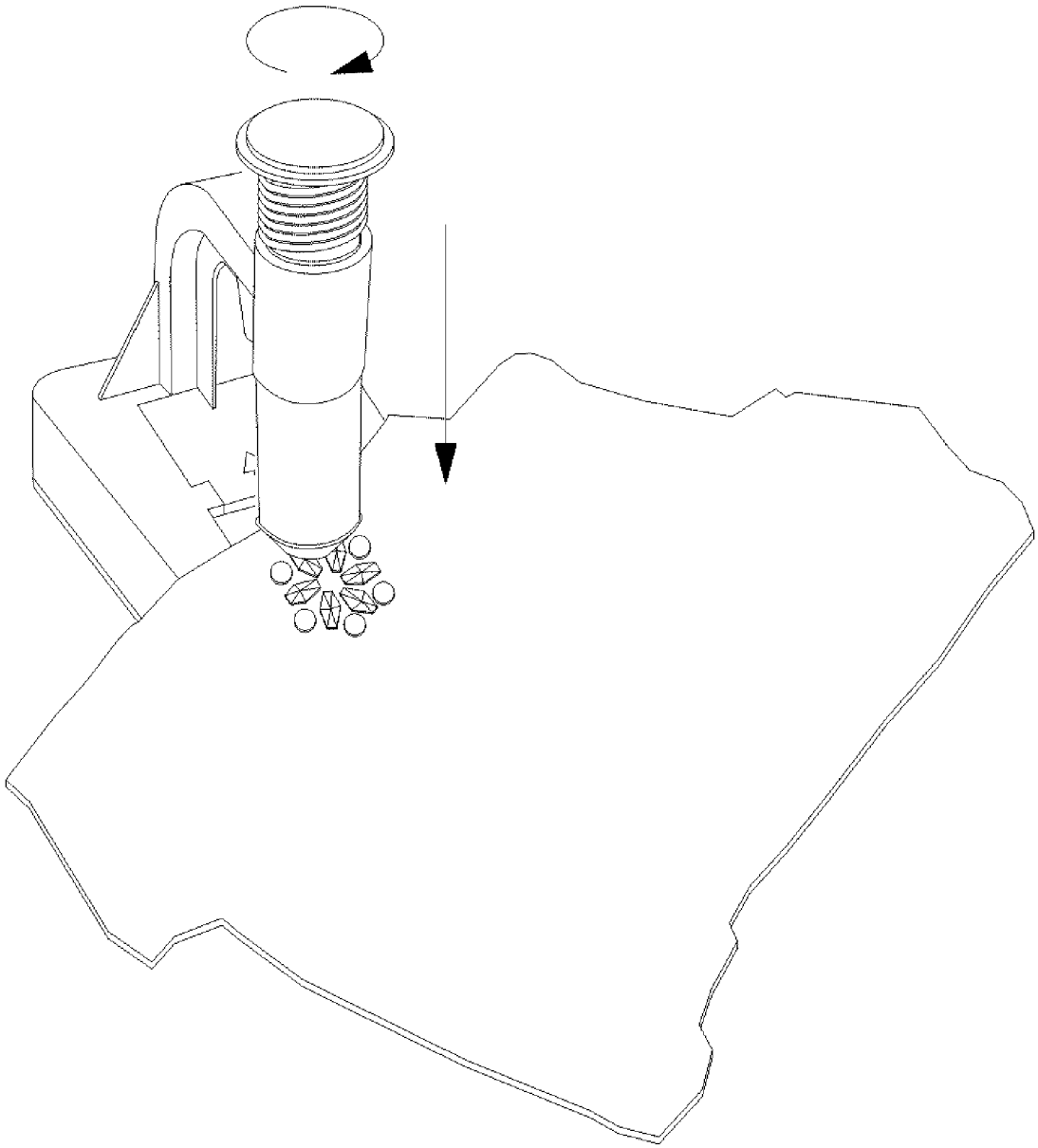
FIG. 6 shows the piston being locked in place.
Figure 7:
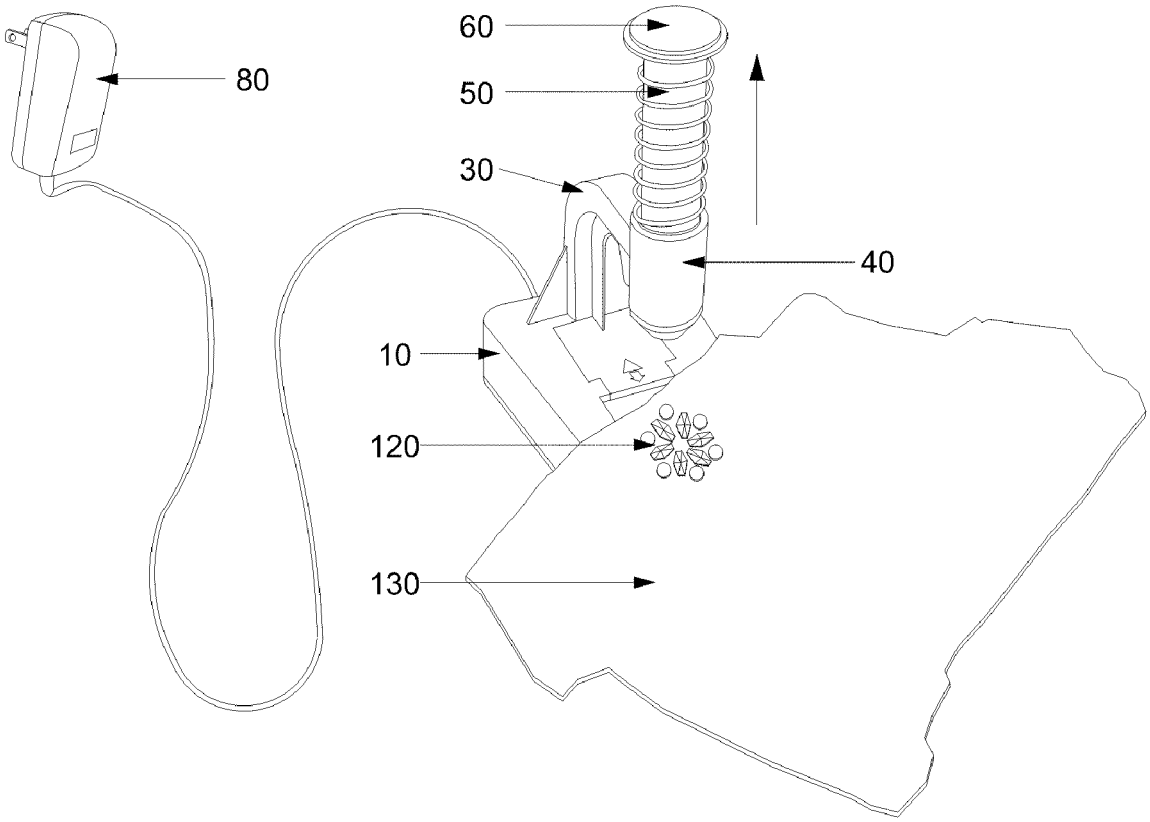
FIG. 7 shows upward force from the spring.

The piston 60, as shown in FIG. 5, has a flat head 61, a body 62 and a piston cap 64. The piston 60 is a cylinder with the flat head 61 in the top of the piston 60 and the piston cap 64 screwing into the bottom of the piston 60. The piston cap 64 is made of a soft, heat resistant material as it applies pressure to a bead 120 to connect it to a piece of material 130. The piston 60 has a plurality locking channel 65 that is a channel that runs straight up and down the piston 60 until it runs at a 90 degree angle. The locking ridges 26 of the piston holder 40 fit into the locking channels 65 of the piston 60. When the piston 60 is at the locking position the piston is turned locking the piston in place as shown in FIG. 6. The piston 60 is placed into the spring 50 with the spring have the same diameter as the piston holder 40. The piston 60 is placed into the piston holder 40 and then the piston cap 64 is screwed on to the bottom of the piston 60. The piston cap 64 had a ridge that has a slightly larger diameter than the piston holder 40. When attached to the piston holder 40 the spring 50 provides an up force to the piston 60 as show in FIG. 7 with the spring 50 being compressed between the rim of the piston holder 40 and the piston's flat head 61.

Figure 8:
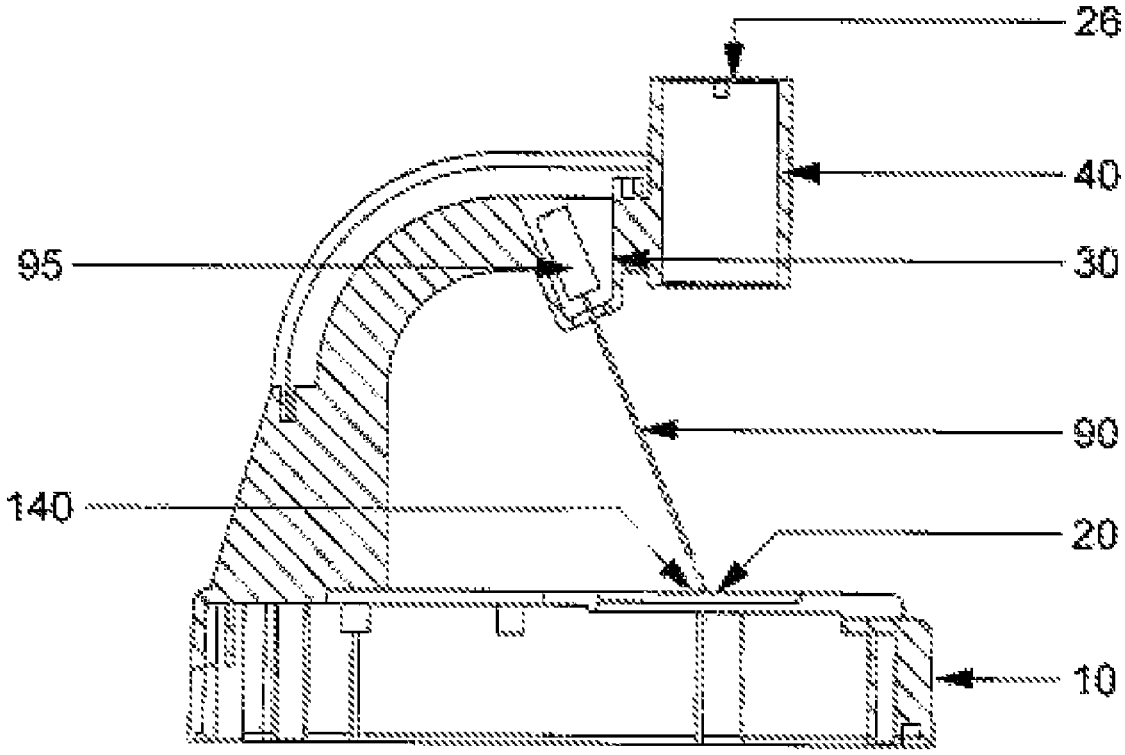
FIG. 8 shows the laser light generator.

A laser light 90 is generated through a laser light generator 95 which is attached to the interior of the piston arm 20 as shown in FIG. 8 in the preferred embodiment and to the power source 80 and is turned on through an on and off button 16. The laser light 90 displays where the bead 120 should be placed on the fabric 130. Once placed the user presses on the flat head 61 of the piston 60. The laser light 90 goes from the laser light generator 95 to the center of the hot plate 20.

The laser light 90 is a light source that sends a laser light beam dot to the center of the hot plate 20 to tell the operator on where to place the bead 120. This improves the process because when the fabric 130 is on top of the hot plate 20, the plate 20 is covered and it is very difficult to tell where the hot plate 20 or the center of the hot plate 20 is.

Although the User can place the bead 120 on fabric 130 and use the center of the piston cap 64 to align, but the laser light 90 is much more accurate and faster.

Figure 9:
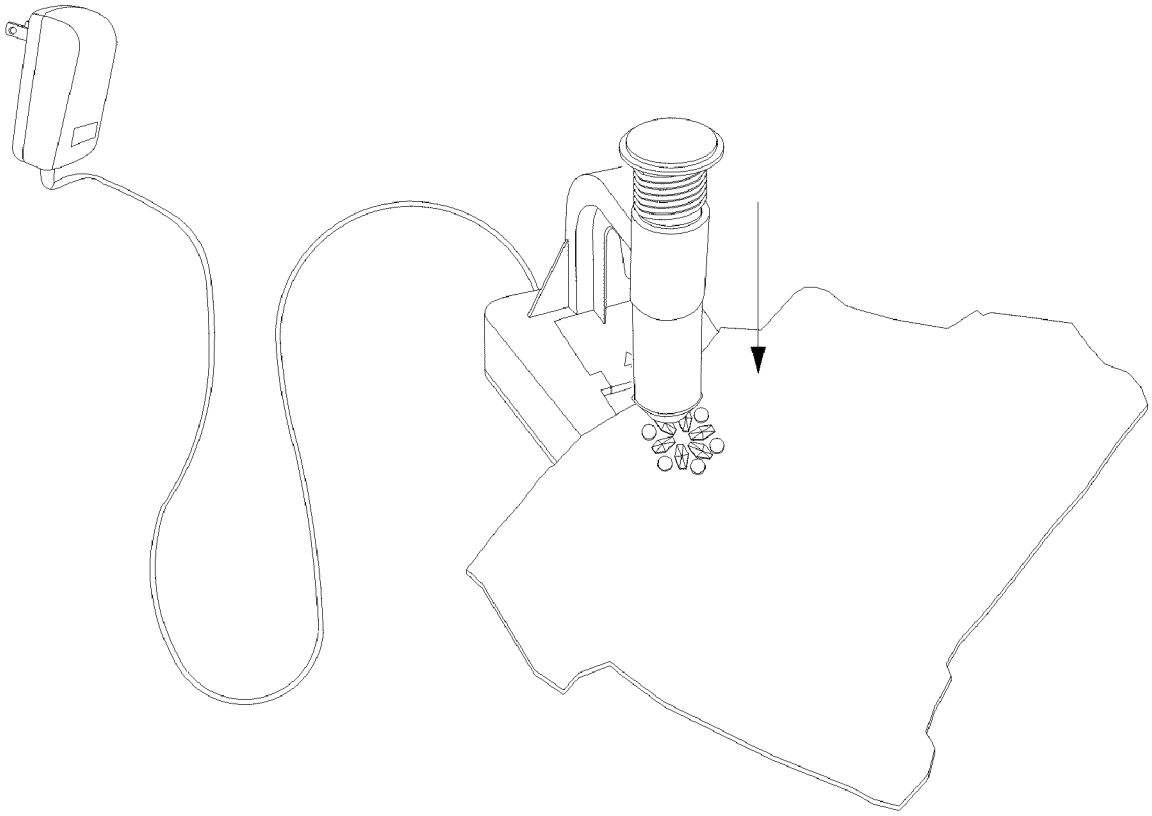
FIG. 9 shows the beads being attached using the device.
Figure 10:
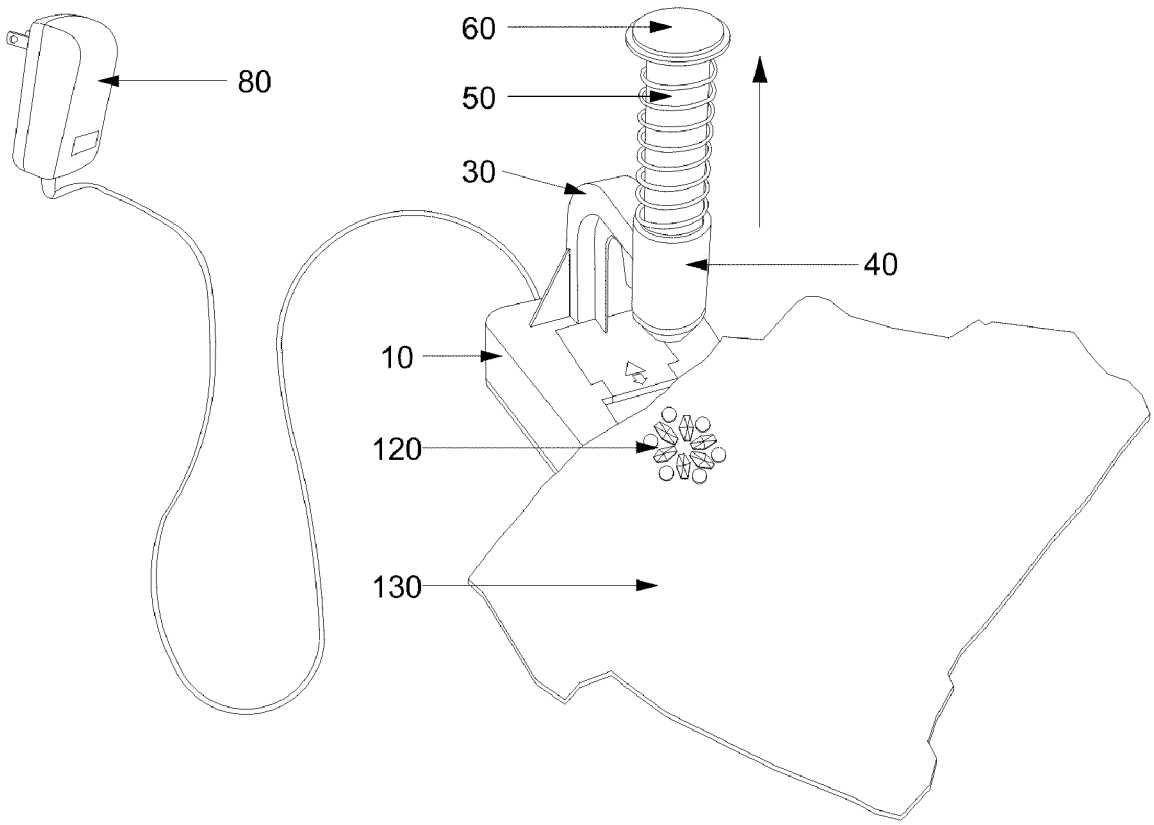
FIG. 10 shows the piston releasing after the beads where attached.

FIG. 9 and FIG. 10 show a close up view of beads 120 being attached to garment 130. It shows how the plastic beads are bonded to fabric. This is the goal of the current invention to do this where any shape or pattern can be made with precision and consistency.

In the preferred embodiment, plastic or acrylic beads would be used, but any material can be used so long as it bonds to the garment 130 under proper heat and pressure that is safe for the garment 130. Multiple colors, shapes and/or textures of beads can be used for this invention or well as different types of garments 130.

Beside the revolutionary primary function of this device 1 and process being used in the machine of Melting and bonding any type of plastic beads 120 to fabric 130, the device 1 can be used with any Hot-Glue based decorative items, these are decorative items that have Melt able glue coating on them, such as metal transfers 131 and rhinestones 132. The glue-based item, like a metal transfer 131 or rhinestones 132 or glue-based beads 125 is placed just like the bead 120 with the laser light 90 displaying where the bead 120 should be placed on the fabric 130. Once placed the user presses on the flat head of the piston 60 pressing the glue-based beads 120 with enough force to heat up and melt the glue on the back of the item and attached it to the fabric 130.

Figure 11:
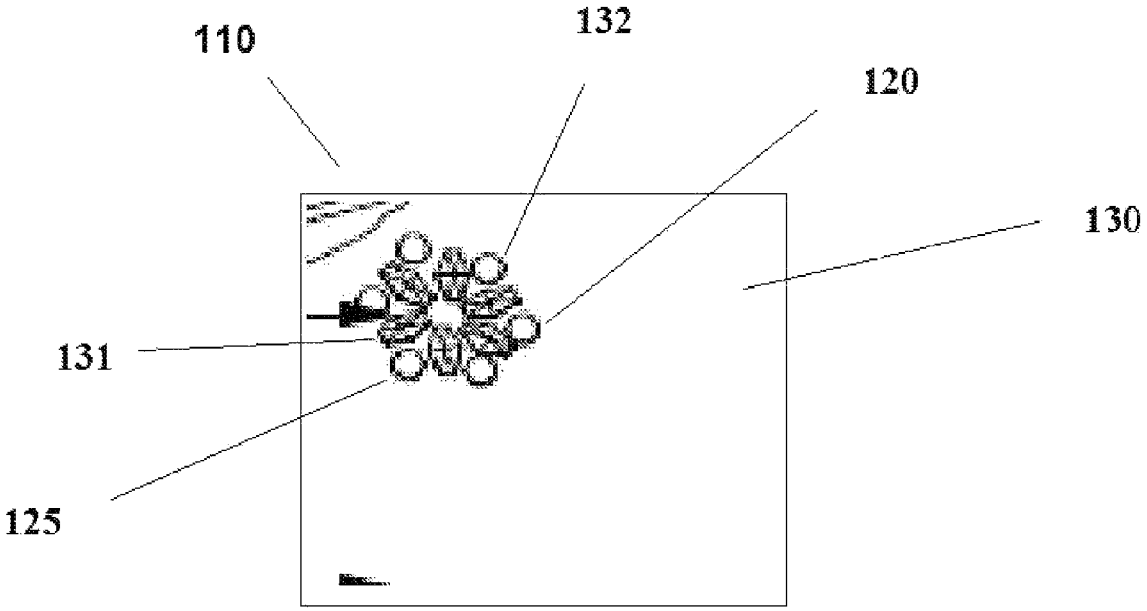
FIG. 11 shows the fabric with the beads attached.

FIG. 11 shows a sample pattern or artwork 110 that can be used with this process.

Figure 12:
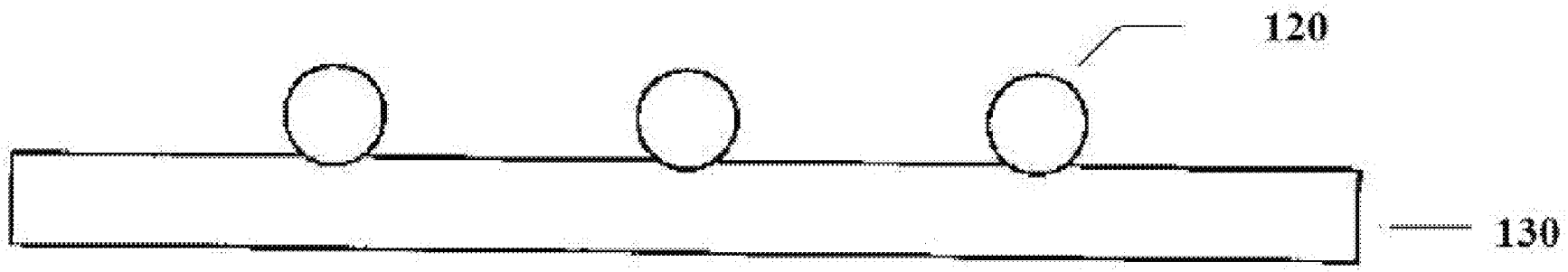
FIG. 12 shows a bead being melted into fabric using the device.

To use the bead attachment device, a user would plug and turn machine and laser light on from the back of the device, in about 30 second the plate should be hot and ready to use. The user will place the fabric 130 on top of the hot plate and place a bead 120 on the top of fabric 130; the laser dot 140 will tell the user the exact position of where the bead 120 will be adhered. The user will press the piston 60 down on top of the bead 120, for most fabric 130, all that is needed is a medium, pressure for four seconds. This action causes the bead 120 to be melted and adhered to the fabric 130 as shown in FIG. 12.

Although many features, functions, and advantages of the present invention have been described in this specification, together with details of the structure of specific embodiments thereof, the description as a whole is illustrative only, and substitutions may be made in detail, especially in matters of shape, dimension and arrangement of elements within the principles of the invention to the full extent indicated by the broad, general meaning of the terms in which the claims are expressed.

ADVANTAGES

The previously described version of the present invention has many advantages, including many elements missing in all prior art. It provides a method of applying plastic beads to fabric where any shape or pattern can be made with speed, precision and consistency. Although many features, functions, and advantages of the present invention have been described in this specification, together with details of the structure of specific embodiments thereof, the description as a whole is illustrative only, and substitutions may be made in detail, especially in matters of shape, dimension and arrangement of elements within the principles of the invention to the full extent indicated by the broad, general meaning of the terms in which the claims are expressed. Therefore, the point and scope of the appended claims should not be limited to the description of the preferred versions contained herein.

That which is claimed is:

1. A device for attaching items to fabric comprising: a base with a hot plate, a piston arm connected to said base and to a piston holder, a spring and piston forming a pressure handle which fits into the piston holder with a power source and a laser light generator, having said piston having a locking position, turning said piston into the locking position, said piston having a plurality of locking channels with a 90 degree turn and having said piston holder has a plurality of locking ridges which the locking ridges fit in where said piston is pushed down to and turned so that the locking ridge turn in at the 90 degree turn to lock the piston in place.

2. A device for attaching items to fabric comprising: a base with a hot plate, a piston arm connected to said base and to a piston holder, a spring and piston forming a pressure handle which fits into the piston holder with a power source and a laser light generator said piston holder being circular in shape, having the internal diameter of said piston holder being slightly more than the diameter of the piston said piston having a plurality of locking channels with a 90 degree turn and having said piston holder has a plurality of locking ridges which the locking ridges fit in where said piston is pushed down to and turned so that the locking ridge turn in at the 90 degree turn to lock the piston in place.

* * * * *